United States Patent [19]

Dilich

[11] Patent Number: 4,813,305

[45] Date of Patent: Mar. 21, 1989

[54] SAFETY MECHANISM FOR VERTICAL CLOSURE

[75] Inventor: Michael A. Dilich, Evanston, Ill.

[73] Assignee: Triodyne, Inc., Niles, Ill.

[21] Appl. No.: 183,371

[22] Filed: Apr. 11, 1988

Related U.S. Application Data

[63] Continuation of Ser. No. 904,376, Sep. 8, 1986, abandoned.

[51] Int. Cl.[4] ..... G05G 1/00; E05F 11/00

[52] U.S. Cl. ..... 74/581; 49/199; 160/188; 74/518; 74/584

[58] Field of Search ..... 74/516, 518, 523, 529, 74/537, 538, 581, 584, 586; 49/199; 160/188, 189; 14/71.1, 71.3, 71.5

[56] References Cited

U.S. PATENT DOCUMENTS

| | | | |
|---|---|---|---|
| Re. 30,104 | 10/1979 | Burnham | 14/71.3 |
| 773,474 | 10/1904 | Chadwick | 74/538 |
| 914,277 | 3/1909 | Howe | 74/518 |
| 2,184,294 | 12/1939 | Fergueson | 74/518 |
| 2,464,097 | 3/1949 | Orscheln | 74/518 |
| 2,699,635 | 1/1955 | Burton | 74/584 |
| 3,220,460 | 11/1965 | Kummerman | 160/188 |
| 3,319,488 | 5/1967 | Bentley et al. | 74/586 |
| 3,439,727 | 4/1969 | Perl | 160/188 |
| 3,466,938 | 9/1969 | Wulff | 74/581 |
| 3,528,118 | 9/1970 | Smith | 14/71.3 |
| 3,584,324 | 6/1971 | Merrick | 14/71.3 |
| 3,620,099 | 11/1971 | Stotz | 74/538 |
| 3,694,840 | 10/1972 | Loblick | 14/71.7 |
| 3,719,005 | 3/1973 | Carli | 49/26 |
| 3,764,874 | 10/1973 | Geoffrey | 318/266 |
| 3,886,614 | 6/1975 | Rosengren | 14/71.7 |
| 4,014,486 | 3/1977 | Nelson et al. | 14/71.3 |
| 4,018,005 | 4/1977 | Harris | 49/199 |
| 4,159,598 | 7/1979 | Galland | 49/28 |
| 4,231,191 | 11/1980 | Ellmore | 49/199 X |
| 4,271,718 | 6/1981 | Bopp et al. | 74/518 |
| 4,292,858 | 10/1981 | Lipshield | 74/518 |
| 4,333,195 | 6/1982 | Lichti | 14/71.5 |
| 4,569,248 | 2/1986 | Hug | 74/581 |
| 4,593,424 | 6/1986 | Beck | 14/71.7 |
| 4,665,579 | 5/1987 | Bennett et al. | 14/71.1 |

FOREIGN PATENT DOCUMENTS

| | | | |
|---|---|---|---|
| 1784239 | 8/1971 | Fed. Rep. of Germany | 160/188 |
| 2235722 | 1/1974 | Fed. Rep. of Germany | 49/199 |
| 444914 | 3/1936 | United Kingdom | 74/581 |
| 1070611 | 6/1967 | United Kingdom | 74/518 |
| 1188672 | 4/1970 | United Kingdom | 49/199 |
| 2147088 | 5/1985 | United Kingdom | 74/523 |

*Primary Examiner*—Richard E. Moore
*Assistant Examiner*—Vinh Luong
*Attorney, Agent, or Firm*—Lee & Smith

[57] ABSTRACT

A collapsible segment for a drive train, preferably a collapsible actuator arm for a vertical door opening mechanism, such as that for a garage door. The actuator arm comprises two primary components, first and second arms which are aligned with one end of one arm pivotally engaging one end of the other arm. A spring under tension extends between the arms on one side of the pivotal connection of the arms in order to normally retain the arms in alignment. The arms are formed such that they cannot pivot toward the spring. The arms are attached to the garage door mechanism at appropriate locations at opposite ends of the arms, with at least one of the attachment locations being offset from the arms on the other side of the pivotal connection such that when compressive force is applied to the arms, and when the force of the spring has been overcome, the arms are urged to pivot about the pivotal connection away from the spring, thus collapsing the actuator mechanism.

20 Claims, 2 Drawing Sheets

Fig. 1
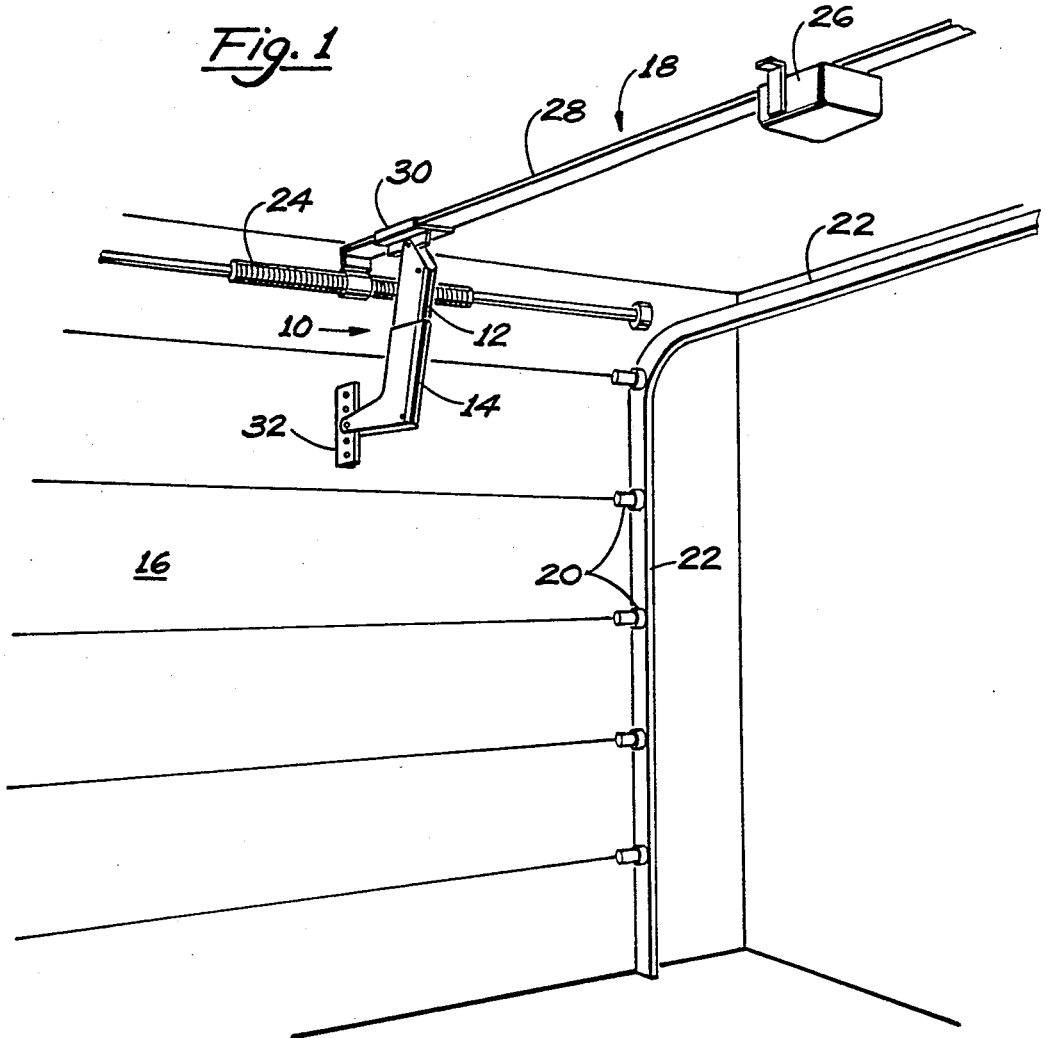
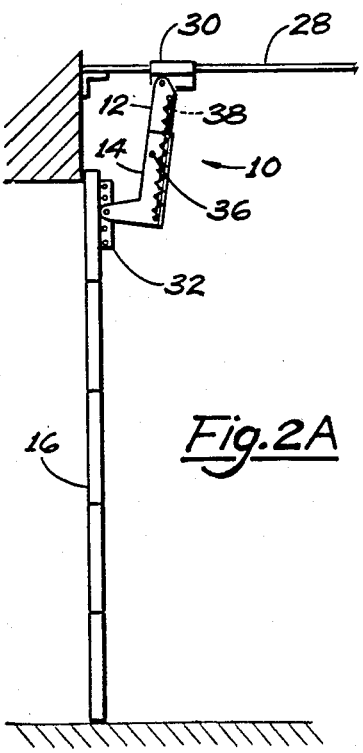
Fig. 2A
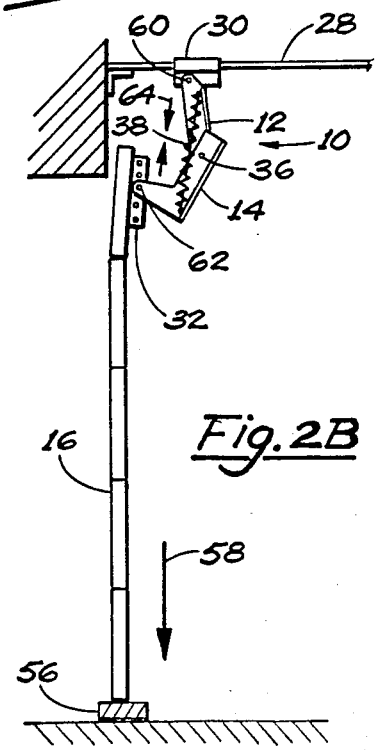
Fig. 2B
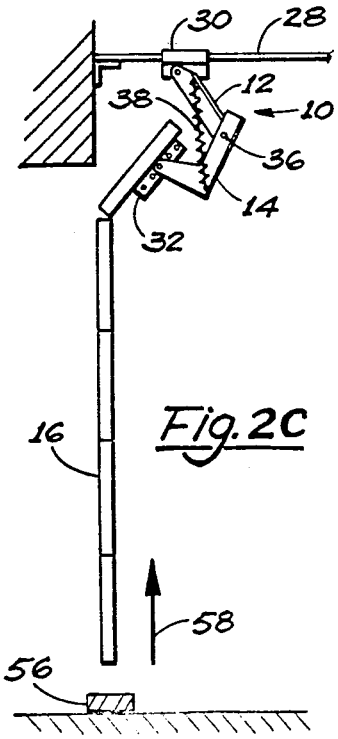
Fig. 2C

SAFETY MECHANISM FOR VERTICAL CLOSURE

This application is a continuation of application Ser. No. 904,376, filed 9/8/86 now abandoned.

BACKGROUND OF THE INVENTION

This invention relates to a collapsible segment for a drive train, and more particularly to a collapsible actuator mechanism for a door opening device, such as that for a vertical garage door.

Garage door opening mechanisms, commonly known as garage door operators or garage door openers, have become increasingly popular, particulary for home installation. With their increasing popularity, however, has come attendant hazards, particularly when installed in a location where small children are present. There are many documented cases where children have been severely injured or killed by garage doors when controlled by an automatic garage door operator. Typically, a child, either playing with the operating mechanism or attempting to "beat" the door as it closes, trips and falls beneath the door and is trapped by the door in its downward progression. If the door is not provided with a reversing mechanism or if the reversing mechanism does not function properly, and if the door closes across the child's chest, the chest is compressed, pinning the child and preventing air flow. If the door closes across the child's neck, strangulation or a fractured neck occurs. If the door closes elsewhere, severe injuries, normally broken bones and internal injuries, occur. Door closing forces typically exceed 100 lbs near the fully closed position.

The emerging hazards of garage door operators have lead to many suggested safety standards for the doors, including (1) automatic rollback or reversing features which will activate when the door encounters an obstruction, (2) "panic" stop switches in addition to any normal activating switch for the door, (3) a strictly manual operating switch for the door such that the door will close or open only while the switch is held closed by the person controlling the door and (4) redundant back-up capability in case of any failure of the garage door operator.

Automatic roll-back or reversing features are normally required for all modern garage door opertors. Various types of reversing mechanisms are quite common, examples being U.S. Pat. Nos. 3,719,005; 3,764,874 and 4,159,598. While such devices are effective when operable, they in turn suffer several deficiencies. If the reversing mechanism becomes inoperable for any reason, obviously the garage door will be just as dangerous as a door without the mechanism. Since the reversing mechanisms are passive devices which do not function unless an obstruction is encountered, a user may innocently continue to use a faulty opener for months or years until an unfortunate time when an obstruction is encountered and the door does not automatically reverse. Also, such devices are typically inhibited during the last one to two inches of travel of the door so that the door is not inadvertently reversed by an uneven floor surface, build up of dirt or snow and ice, or other floor obstructions. However, since proper functioning of the inhibition mechanism is subject to variables such as wear, adjustment, installation geometry and friction, often it has been found that instead of the final two inches of closure inhibiting the reversing mechanism, actually a far greater span is inhibited. Again, particularly when small children are involved, inhibiting the reversing mechanism can lead to tragic consequences.

Other advances have recently been incorporated in garage door operators. Many such operators now being marketed include a redundant reversing mechanism which reverses the door if it does not fully close within a particular duration of time. The timing mechanism adds another level of complexity to the circuitry for the garage door operator, and adds further opportunity of age or wear to cause its inaccuracy or total nonfunctioning. Furthermore, even if the timing mechanism is operating properly, the amount of time that a door may bear upon a trapped child before reverse of the door occurs may be more than enough to cause serious injury or death.

The effectiveness of garage door reversing and inhibiting mechanisms is dependent upon proper installation and maintenance, two variables which are normally outside of the control of the manufacturer of the garage door operator. What is required is a dependable device to permit release of the downward pressure of the garage door that is not dependent upon the presence or absence of electrical power, adjustment of the garage door reversing mechanism or timing mechanism, or any other feature of the garage door operator that is subject to wear or maladjustment.

SUMMARY OF THE INVENTION

The present invention overcomes the above-identified deficiencies of the prior art, and others, by providing a collapsible segment for a drive train of an operator which will allow partial retraction of a garage door or any other vertical door or closure in which the segment is installed. As primary components, the segment includes a driving element and a driven element, with the two elements being connected to the drive train at first and second locations spaced a given distance at opposite ends of the segment. Means is provided for normally retaining the elements in registration with one another, with the retention means being configured for permitting some relative movement between the two elements when compressive force is sustained by the elements, thereby decreasing the given distance between the first and second attachment locations. Also associated with the retention means is a means for collapsing the segment by drawing the first location toward the second location when compressive force greater than a predetermined minimum force is sustained by the two elements. In doing so, and particularly when installed as part of the drive train for a sectional garage door, the door will actually be raised a certain distance or can be pushed upwardly a distance sufficient for a trapped individual to extricate himself.

In accordance with the preferred embodiment of the invention, relative movement between the two elements is permitted only when the compressive force sustained by the elements is greater than the predetermined minimum force. At all other times, the two elements remain in perfect registration as a part of the drive train for the door operator. Also in accordance with the preferred embodiment of the invention, the collapsing means will not activate to collapse the segment until the given distance between the first and second attachment locations has been decreased a predetermined amount. Thus, if a slight obstruction occurs, the collapsible segment will not fully collapse.

In accordance with the disclosed embodiment of the invention, the driving element comprises a first arm and the driven element comprises a second arm, with the two arms being aligned in registration by the retention means. The arms are pivotally connected, and the collapsing means includes a spring extending between the arms on one side of their pivotal connection. The arms are prevented from pivoting toward the spring so that the arms will be in their normal lineal registration when the spring is under tension.

The segment is connected in the driven train for a door operator at opposite ends of the two arms. At least one of the two locations at which the segment is connected is offset to one side of the pivotal connection of the two arms so that the resultant compressive force experienced by the segment is at the opposite side of the pivot from that where the spring is located. In accordance with the preferred embodiment of the invention, when sufficient compressive force is experienced by the segment, the two arms pivot and the spring is both further extended and also translated in the direction of the pivot. When the spring passes through the location of the pivot, the force of the spring causes the two arms to collapse by being drawn rapidly toward one another. The amount which the two arms are drawn toward one another can be limited by installation of a rod within the interior of the spring. So long as the rod has a length greater than the length of the spring when not under tension, the rod will limit the collapse by limiting the retraction of the spring.

BRIEF DESCRIPTION OF THE DRAWINGS

The invention is described in greater detail in the following description of examples embodying the best mode of the invention, taken in conjunction with the drawings, in which:

FIG. 1 is perspective view of a collapsible segment according to the invention when installed within the drive train for a garage door operator, FIGS. 2A through 2C are side elevational views of the segment and installation of FIG. 1 showing both proper closure of the door and also the events that occur if an obstruction is encountered.

DESCRIPTION OF EXAMPLES EMBODYING THE BEST MODE OF THE INVENTION

Figure 3:
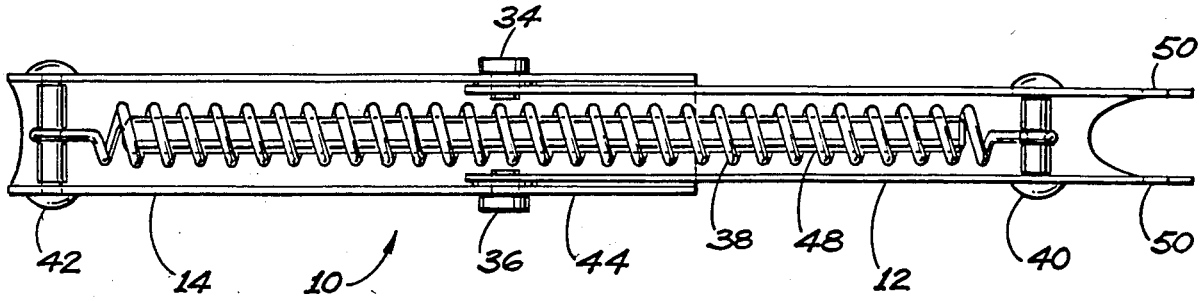
FIG. 3 is an enlarged top plan view of the invention.

One embodiment of the invention is shown in conjunction with the drawing figures. While preferably the invention is used in connection with the operator for a segmented garage door in a residential environment, it is quite obvious that the invention can be employed in connection with any type of closure in any environment, whether it be residential, commercial or otherwise. In addition, while only a single embodiment of the invention is illustrated in the drawings, as will be evident and as described in somewhat greater detail below, the invention can assume many different forms.

A collapsible segment for a drive train is shown generally at 10 in the drawing figures and is composed of two basic components, a driving element or first arm 12 and a driven element or second arm 14. The arms 12 and 14 and the functioning of the collapsible segment 10 is described in considerable detail below.

The collapsible segment 10 is shown installed in place of what is commonly known as the actuator arm or actuator element for a garage door operator. The actuator arm is that component which effects a direct connection between a garage door 16 and an automatic door operator mechanism 18. Neither the garage door 16 nor the door operator mechanism 18 forms a part of the invention, and can either be selected from any of a myriad of conventional designs. As is typical, the garage door 16 is composed of a series of segments which have wheels 20 at opposite ends and which travel in a track 22. To balance the weight of the garage door 16, a spring 24 and associate linkage is connected to the garage door 16 in a conventional fashion.

The automatic door operator mechanism 18 is composed of a motor 26 secured to the ceiling of the garage and connected to a track 28 upon which a traveler 30 is translated. The traveler 30 can be driven by a screw mechanism, chain drive, or any other type of conventional mechanism as may be desired. The track 28 is held rigidly in place so that when the motor 26 is activated, the traveler 30 is driven to and fro to either raise or lower the garage door 16.

The collapsible segment 10 is, as illustrated in FIGS. 1 and 2, connected between the traveler 30 and a bracket 32 secured near the top of the garage door 16. As explained above, the segment 10 is intended to replace the typical L-shaped non-collapsible actuator arm of conventional garage door operators. When the operator is functioning properly, the segment 10 functions in a manner identical to the typical actuator arm of any conventional garage door operator. When an obstruction is encountered or when excessive force is required to close the garage door for any reason, the collapsible nature of the segment 10 is activated as shown graphically in FIG. 2 and described in further detail below.

Figure 4:
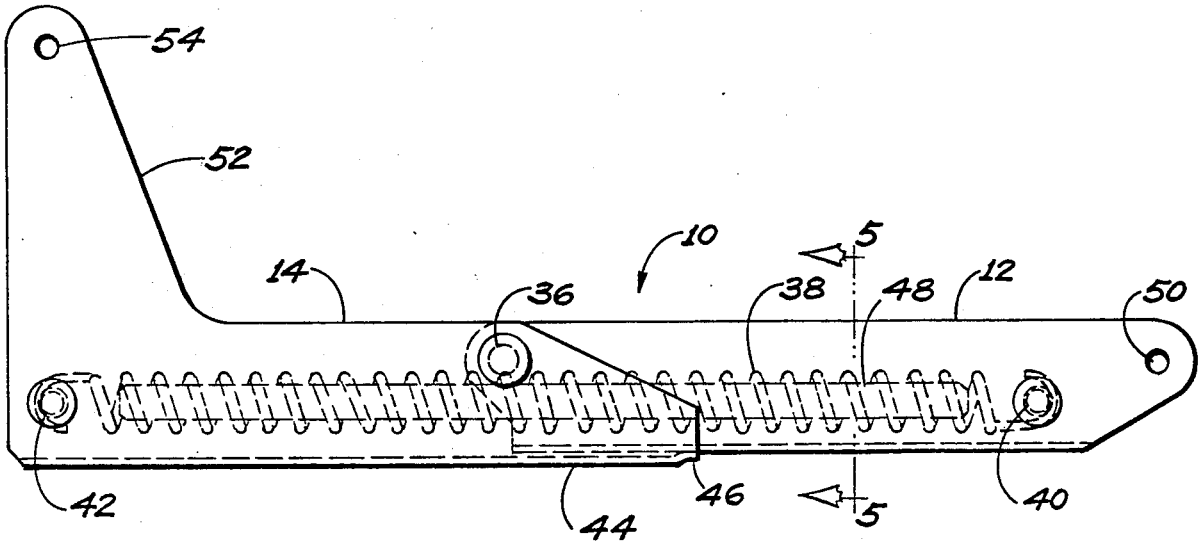
FIG. 4 is a side elevational view of the invention as illustrated in FIG. 3.
Figure 5:
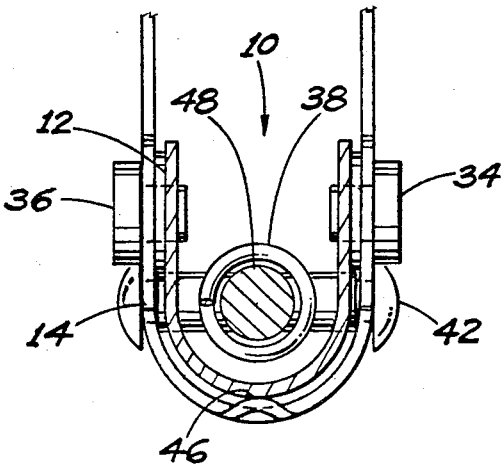
FIG. 5 is a further enlarged cross sectional illustration taken along lines 5—5 of FIG. 4.

The two arms 12 and 14 of the collapsible semgent 10 are, as best shown in FIGS. 3 through 5, generally U-shaped in cross section, with the arm 12 being shaped to fit within the arm 14. The arms 12 and 14 are hinged for pivoting relative to one another by means of pins 34 and 36 which extend through adjacent legs of the opposite sides of the arms 12 and 14. As best shown in FIGS. 3 and 5, the pins 34 and 36 extend, respectively, only a short ditance into the interior of the collapsible segment 10 so as not to inhibit the collapsing function, as described below. The pins 34 and 36 together form a pivot point about which the arms 12 and 14 can rotate when collapsible force is applied to the collapsible segment 10.

A spring 38, under tension, is located within the U-shaped channel of the arms 12 and 14, extending between a pin 40 secured within the arm 12 and a pin 42 secured within the arm 14. Because the spring 38 is stretched under tension, and because the spring 38 is installed at one side of the pivot created by the pins 34 and 36, in order to prevent rotation of the arms 12 and 14 toward the spring 38 (downwardly in FIG. 4), a stop in the form of and extension 44 is provided extending beyond (to the right in FIGS. 3 and 4) the point of pivot of the two arms 12 and 14. The extension 44 terminates at a protuberance 46 which bears against the arm 12 to retain the arms 12 an 14 in proper lineal registration, as illustrated in the drawing figures.

Preferably the spring 38 is a coil spring with a hollow interior, and a rod 48 is installed therewithin to limit the collapsing of the arms 12 and 14 when the segment 10 is collapsed. The length of the rod 48 is greater than the length of the spring 38 when relaxes (when not under tension) so that even when the segment 10 is collapsed, the spring 38 remains constantly under tension.

For attachment to the traveler 30, the arm 12 is provided with an aperture 50 extending therethrough. Similarly, an integral leg 52 extends from the second arm 14 and is provided with an aperture 54 extending therethrough for attachment to the door bracket 32. As illustrated quite clearly in FIG. 4, the leg 52 and aperture 54 are offset from the pivot between the two arms 12 and 14 (composed of the pins 34 and 36) so that when compressive force is applied to the segment 10 at either end thereof, a force vector resulting from the force lies on the opposite side of the pivot from the location of the spring 38. If the holding force of the spring 38 is overcome, compressive force will rotate the arms 12 and 14 about the pivot pins 34 and 36.

The collapsible segment 10 functions in the following manner. With reference to FIG. 2, when the door 16 is closed by the automatic door operator mechanism 18, force is applied from the travel 30 through the segment 10 to the bracket 32 attached to the top of the garage door 16. In normal operation, the door closes fully, as shown in FIG. 2A, and the segment 10 remains at all times in its generally L-shaped configuration. However, if, during closure of the door 16, an obstruction 56 is encountered, as the motor 26 continues to drive the traveler 30 and attempts to force the door 16 downwardly as indicated by the arrow 58, the compressive force sustained by the segment 10 increases until the holding force of the spring 38 is overcome, and the arms 12 and 14 begin to pivot relative to one another about the pivot pins 34 and 36. If the automatic operator mechanism 18 continues to drive the door downwardly and does not reverse, the two arms 12 and 14 continue to pivot relative to one another as shown in FIG. 2B. The spring 38 remains straight, and therefore, as the arms 12 and 14 pivot, the spring passes between the spaced pivot pins 34 and 36. During this time, the point of attachment 60 of the arm 12 to the traveler 30 is pivoted toward the point of attachment 62 of the arm 14 to the bracket 32, as indicated by the arrows 64 in FIG. 2B. As soon as the spring passes between the pivot pins 34 and 36, it crosses into an "over-the-center" location, tending to collapse the arms 12 and 14 toward one another and raise the door 16 as shown in FIG. 2C by the reversed direction of the arrow 58. Thus, whatever the obstruction 56 may have been, its removal is readily accomplished. If a human being had been caught beneath the door 16, automatic partial raising of the door 16 by the spring 38 allows the person to extricate himself without having to force the door 16 upwardly. This is particularly advantageous if a panicked child had been caught beneath the door 16 during its downward travel.

As shown in FIG. 2C, during collapsing of the segment 10, the top of the door 16 is drawn toward the first arm 12. If unrestricted collapse of the segment 10 were permitted, the door 16 would actually strike the first arm 12, possibly causing damage. The rod 48 prevents such action by limiting the collapse of the segment 10. When collapse has occured, the rod 38 bears between the pins 40 and 42, preventing further collapse of the segment 10 beyond approximately that shown in FIG. 2C.

ACHIEVEMENTS

The present invention provides a simple, yet highly effective means of permitting manual partial retraction of the downward travel of the garage door 16, even if the automatic door operator mechanism 18 continues to attempt to drive the door downwardly. Thus, even when the automatic reverse and/or timing mechanisms of the automatic door operator mechanism 18 are inoperative, do not operate properly, or are nonexistent, any obstruction caught beneath the door 16 will trigger the collapsing of the segment 10. The force required to initiate collapsing of the segment 10 is set high enough to maintain lineal registration of the arms 12 and 14 during the normal closing of a properly adjusted door bu not so high as to cause the door to inflict serious injury to an entrapped individual. As the segment 10 collapses, the strength of the spring 38 automatically tends to raise the door 16 without any further aid, a considerable safety advantage, particularly if the reversing mechanism of the automatic door operator mechanism 18 fails to function and the traveler 30 has been driven to its final destination.

If a small obstruction, such as a stone, a hose, or a small ice accumulation is encountered beneath the door 16, the collapsing of the segment 10 need not occur unless the points of attachment 60 and 62 are drawn toward one another sufficiently that the spring 38 is in an over-the-center orientation, having passed between the pivot pins 34 and 36. Thus, the door 16 can be effectively fully closed, even if a small obstruction is encountered, without initiating the collapsing function of the spring 38.

Even if the segment 10 is collapsed, it can readily be returned to its normal orientation shown in FIGS. 1 and 2A by simply reversing the motor 26 to raise the door 16 upwardly. Holding the door 16 against reversal readily snaps the two arms 12 and 14 into place, thus eliminating the need for the owner to find a ladder and manually return the segment 10 to its normal lineal orientation.

While the segment 10 is intended to collapse only when the door 16 is close to being closed, due to the nature of the segment 10, it will be apparent that collapse will occur whenever an obstruction is encountered, an advantage under some circumstances. Also, the spring 38 will permit premature collapse of the segment 10 if the garage door 16 becomes misaligned or otherwise restrained and greater than normally necessary force is required of the operator mechanism 18. While the door may still be closed (manually for the last several inches), premature collapse of the segment 10 signals that maintenance is needed.

Various changes can be made to the invention without departing from the novel spirit thereof. For example, although a collapsible segment having pivotal arms 12 and 14 has been illustrated, it could readily be replaced by a non-pivotal device in which one arm slides within the other against the force of a spring. In such a device, after a certain degree of compression has been accomplished, similar to the rotation of the two arms 12 and 14 as they approach the over-the-center orientation, a trigger can be incorporated to release the spring force to cause rapid collapsing of the telescoping arms. Alternatively, a conventional L-shaped segment can be used and a similar collapsing mechanism can be secured to the top panel of the garage door 16. The scope of the invention is defined by the following claims.

What is claimed is:

1. In a drive train of a vertical door opening device, the improvement comprising a collapsible segment forming a link in the driven train, the segment comprising a. a driving element and a driven element, said driving element including means for connecting said driving element to the drive train at a first location and said driven element being including means for connecting said driven element to the drive train at a second location spaced a given distance from said first location;

b. retention means retaining said driving element in registration with said driven element, said retention means including means for permitting relative movement between said elements when compressive force is sustained by said elements, thereby decreasing said given distance, and c. said retention means including means for collapsing the segment by drawing said first location toward said second location when compressive force greater than a predetermined minimum force is sustained by said elements.

2. A collapsible segment according to claim 1 in which said means for permitting relative movement is formed to permit such movement only when the compressive force sustained by said elements is greater than said predetermined minimum force.

3. A collapsible segment according to claim 2 in which said collapsing means draws said first location toward said second location after said given distance has been decreased a predetermined amount.

4. A collapsible segment according to claim 1 in which said driving element comprises a first arm having first and second ends, and in which said driven element comprises a second arm having first and second ends, said arms being aligned in registration by said retention means with said second ends adjacent one another.

5. A collapsible segment according to claim 4 in which said means for permitting relative movement comprises a pivotal connection of said first arm to said second arm at said second ends.

6. A collapsible segment according to claim 5 in which said collapsing means includes a spring comprising a part of said retention means, said spring extending between said arms on one side of said pivotal connection.

7. A collapsible segment according to claim 6 including means to inhibit pivoting of said arms about said pivotal connection.

8. A collapsible segment according to claim 7 in which said means to inhibit comprises a stop of one of said arms on said one side of said pivot.

9. A collapsible segment according to claim 5 in which said first location is located at the first end of said first arm and said second location is located at the first end of said second arm, at least one of said locations being offset to one side of said pivotal connection.

10. In a drive train of a vertical door opening device, the improvement comprising a collapsible segment forming a link in the drive train, the segment comprising, a. a first arm having first and second ends and a second arm having first and second ends, said arms normally being aligned with said second ends adjacent one another, b. means for connecting the sement in the drive train comprising a first attachment location at the first end of said first arm and a second attachment location at the first end of the second arm, c. means pivotally connecting said first arm to said second arm at said second ends, d. retention retaining said first arm in registration with said second arm, said retention means including means for permitting pivoting of said arms relative to one another about said means pivotally connecting when compressive force is sustained by said arms, and e. said retention means further including means for collapsing the segment by drawing said arms toward one another when compressive force greater than a predetermined minimum force is sustained by said arms.

11. A collapsible segment according to claim 10 in which said pivotal connecting means comprises a pin.

12. A collapsible segment according to claim 10 in which said collapsing means comprises a spring extending between said arms on one side of said pivotal connecting means.

13. A collapsible segment according to claim 12 including means to limit collapsing of the segment.

14. A collapsible segment according to claim 13 in which said spring is a coil spring under tension and said limit comprises a rod located within said spring, said rod having a length greater than the length of said spring when not under tension.

15. A collapsible segment according to claim 10 in which at least one of said attachment locations is offset to one side of said pivotal connecting means.

16. A collapsible actuator mechanism forming a link in a drive train of a vertical door device, comprising a. a first arm and a second arm, said arms being U-shaped in cross section and normally being aligned with one end of the arm engaging one end of the other arm, b. a pivotal connection of said arms at said engaging ends, c. a spring extending between said arms on one side of said pivotal connection, said spring being under tension such that said arms are urged to pivot about said pivotal connection towards said spring.

d. means to inhibit pivot of said arms toward said spring, and e. a first attachment location said first arm and a second attachment location on said second arm, at least one of said attachment locations being offset from said arms on the other side of said pivotal connection such that when compressive force is sustained by said arms, said arms are urged to pivot about said pivotal connection away from said spring.

17. A collapsible actuator mechanism according to claim 16 in which said inhibit means comprises an extension of one of said arms adjacent the other arm.

18. A collapsible actuator mechanism according to claim 16 in which one of said arms is shaped to fit within the other of said arms, and in which said pivotal connection comprises a pinned junction of adjacent legs on opposite sides of said U-shaped arms.

19. A collapsible actuator mechanism according to claim 18 in which said spring is located to pass between said pinned junctions during pivot of said arms.

20. A collapsible actuator mechanism according to claim 19 in which said spring is a coil spring, and including a rod located within said spring to limit collapsing of the segment, said rod having a length greater than the length of said spring when not under tension.

* * * * *